United States Patent [19]

Habegger, deceased

[11] 4,124,961

[45] Nov. 14, 1978

[54] BUILDING BRICK

[75] Inventor: Willie Habegger, deceased, late of Currumbin, Australia, by Carl Habegger, executor

[73] Assignee: Lock Brick Limited, Toronto, Canada

[21] Appl. No.: 806,399

[22] Filed: Jun. 14, 1977

[51] Int. Cl.[2] ..... E04C 1/10; E04C 1/30

[52] U.S. Cl. ..... 52/592; 52/286; 52/595; 52/603

[58] Field of Search ..... 52/284–286, 52/589–595, 436, 586, 603, 610; 46/25

[56] References Cited

U.S. PATENT DOCUMENTS

| | | | |
|---|---|---|---|
| 1,545,173 | 7/1925 | Trost | 52/589 |
| 3,534,518 | 10/1970 | Zagray | 52/595 |

FOREIGN PATENT DOCUMENTS

| | | | |
|---|---|---|---|
| 1,133,494 | 11/1956 | France | 52/595 |
| 322,150 | 7/1957 | Switzerland | 52/586 |
| 223,820 | 1924 | United Kingdom | 52/589 |
| 708,688 | 5/1954 | United Kingdom | 52/284 |

*Primary Examiner*—James L. Ridgill, Jr.
*Attorney, Agent, or Firm*—Rogers, Bereskin & Parr

[57] ABSTRACT

A building brick having upper and lower faces. The upper face has a pair of longitudinally extending triangular ridges along each side thereof, each ridge having a narrow flat apex surface. The lower face has a pair of complementary depressions formed by a central longitudinally extending upstanding portion of height less than the height of the ridges, so that when similar bricks are engaged, their depressions and ridges interlock to align their viewable faces and restrain movement of the bricks in a transverse direction, while leaving a space at least 0.3cm thick and of width equal to at least 40 percent of the width of each brick, between successive rows of bricks to contain bonding material, and with the upper brick resting on the apex surfaces of the brick beneath it. A similar vertical space is provided between the end faces of the bricks, so that a wall can be assembled without mortar and can then be mortared by pouring a thin mortar into one or more of the vertical spaces.

4 Claims, 21 Drawing Figures

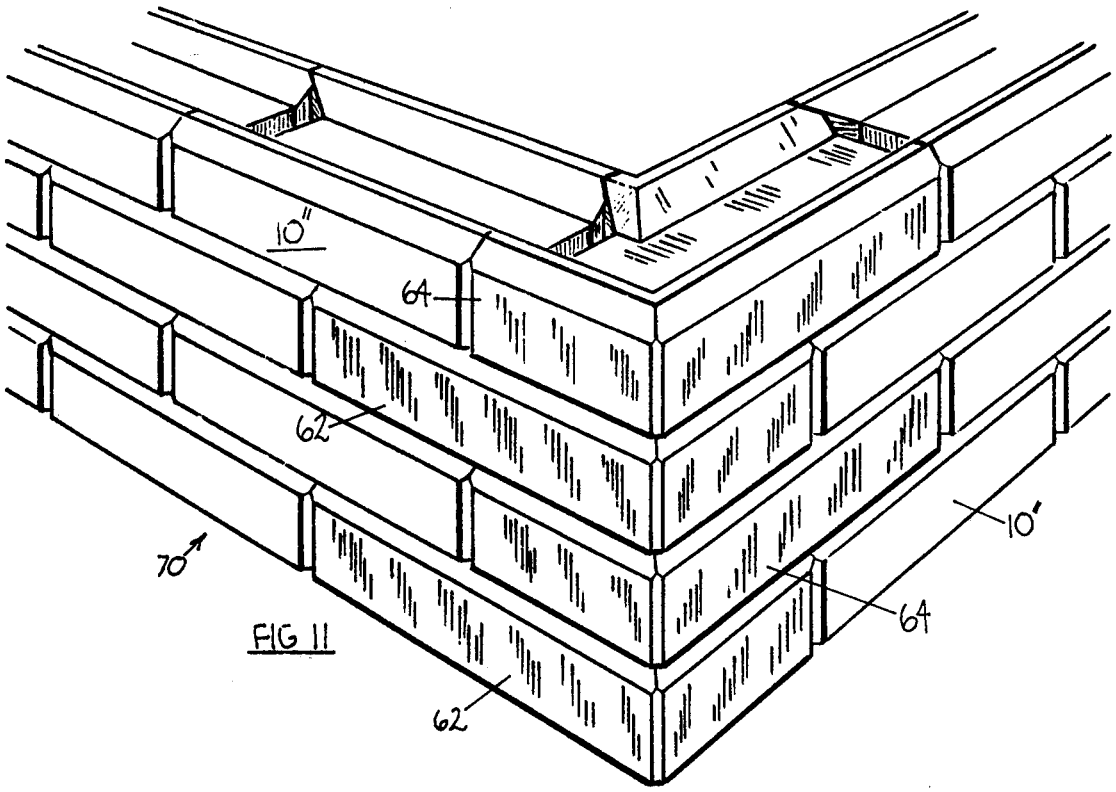
FIG 11
FIG 12
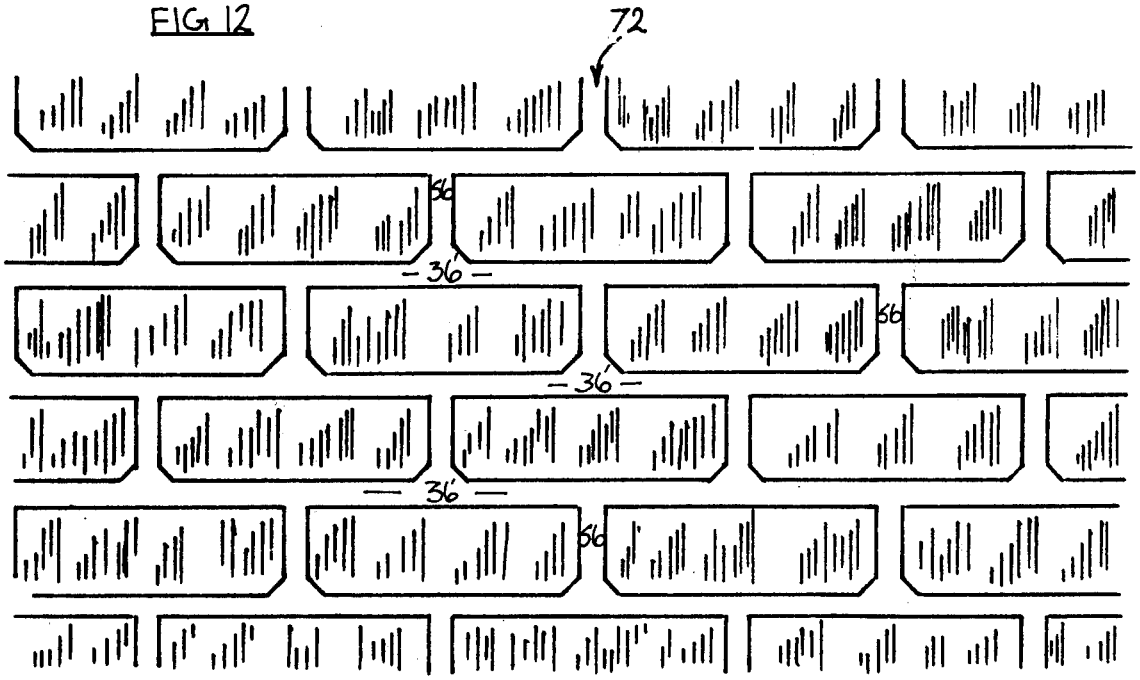

BUILDING BRICK

BACKGROUND OF THE INVENTION

This invention relates to a building brick and more particularly it relates to an improved self aligning building brick.

This invention has been devised to provide a self aligning building brick which will be easy to place and which will have a strong structural joint between adjoining bricks. It is also an object of this invention to provide a building brick usable for constructing a wall of the like which will have a uniform and pleasing appearance. It is also an object of this invention to provide a building brick which is easy to manufacture and robust in use.

BRIEF SUMMARY OF THE INVENTION

A preferred embodiment of the building brick of the invention is as follows. The brick has upper and lower faces, first and second end faces, and first and second side faces. The upper face of the brick has a pair of parallel upstanding ridges one adjacent each side of the brick and each ridge extending substantially the entire length of the brick. The upper face also has a recessed portion between the ridges, such recessed portion also extending substantially the entire length of the brick.

Each of the ridges at the upper face of the brick is substantially triangular in form, having an outer surface which slopes steeply in the direction towards its adjacent side face and towards the bottom face of the brick, a narrow flat apex surface, and an inner surface which slopes steeply laterally inwardly towards the recessed portion.

The lower face of each brick has a pair of narrow flat depressed surfaces, one at each side of the brick and extending the entire length of the brick, and a raised portion between the depressed surfaces. The raised portion has sides which slope laterally outwardly to meet the depressed side surfaces.

The ridges and the depressed surfaces, and the raised and recessed portions are complimentary in height and location, so that when one brick is placed atop another, the inner surfaces of the ridges meet and lie against the sides of the raised portion to align the side faces of the brick and to restrain sideways movement of one of the bricks relative to the other.

The depressed side surfaces of the upper brick are in vertical alignment with and rest sealingly on the flat apex surfaces of the lower brick and the apex surfaces of the lower brick thereby carry the weight of the upper brick.

The projection of the ridges beyond the first recessed portion is at least 0.3 centimeters greater than the projection of the first raised portion beyond the depressed side surfaces, to provide a horizontal space at least 0.3 centimeters high between successive rows of bricks, for bonding material. The width of this space is at least 40% of the width of the bricks.

The ends of the bricks also define a vertical sealed space, at least 0.3 centimeters thick, extending the entire height of the bricks when two bricks are placed end to end.

Thus, according to the invention, a wall may be assembled by first assembling the bricks as indicated, without mortar. Any debris on the tops of the apex surfaces may be swept either to the side, where it will fall off the bricks, or into the recessed portions between the ridges on the upper faces of the bricks, where it will not interfere with the precise alignment of the bricks. Then flowable bonding material, normally a runny mortar, may be poured or forced through one or more of the vertical spaces between the end faces of thr bricks. The flowable bonding material runs down through the vertical spaces and sideways through the horizontal spaces so that the bricks in the wall can be rapidly mortared without the need to individually mortar each brick.

BRIEF DESCRIPTION OF THE DRAWINGS

In the accompanying drawings:

FIG. 11 is a perspective view of a corner of a wall made from bricks of the invention;

FIG. 12 is a side sectional view of a wall made from bricks of the invention;

DESCRIPTION OF THE PREFERRED EMBODIMENTS

Figure 1:
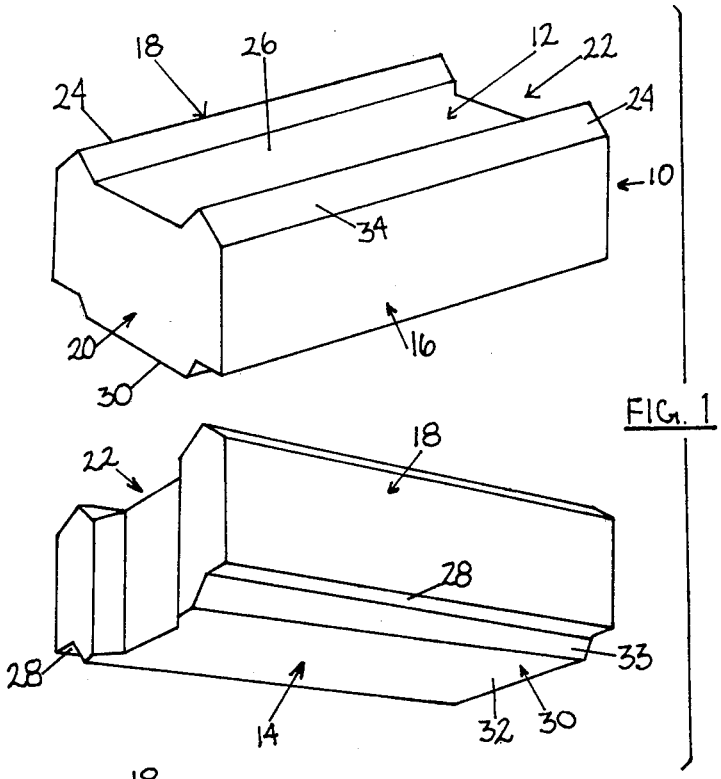
FIG. 1 is a perspective view of a pair of bricks shown in spaced apart relationship one above the other.
Figure 2:
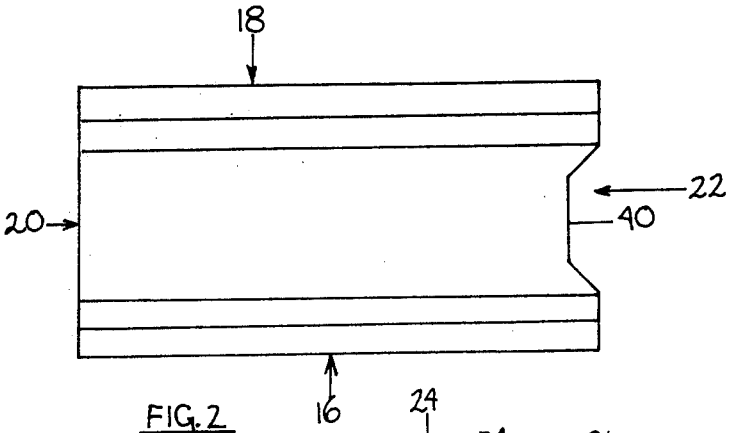
FIG. 2 is a plan view of either brick illustrated in FIG. 1.
Figure 3:
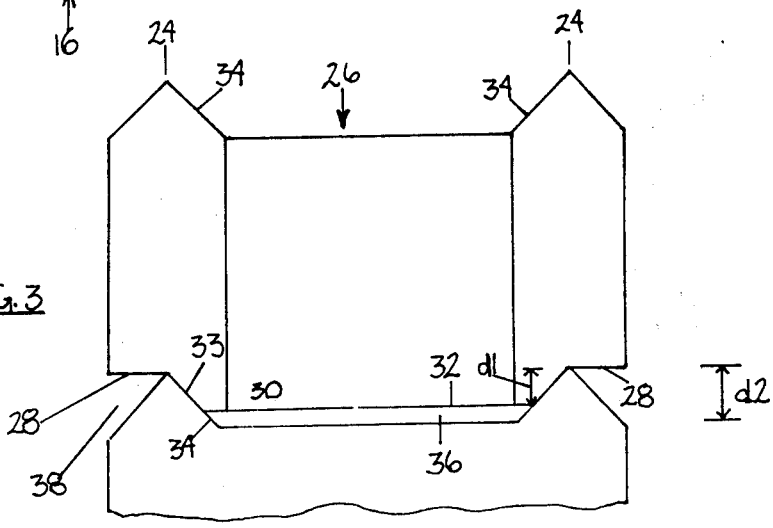
FIG. 3 is an end view of a pair of bricks in operative relation one above the other.

Reference is first made to FIGS. 1 to 3, which show a building brick 10 having an upper face 12, a lower face 14, side faces 16 and 18, and end faces 20, 22. These faces are all substantially rectangular, except for the interlocking features to be described.

The upper face 12 has a pair of longitudinally extending engagement ridges 24 which extend the entire length of the brick, one at each side of the brick. The ridges 24 are triangular in shape and define between them a flat recessed area 26.

The lower face 14 has a pair of depressed surfaces 28, one at each side of the brick and each also extending the entire length of the brick. Located between the depressed surfaces 28 is a raised or projecting portion 30 having a flat lower surface 32 and sides 33 which slope at the same angle as the angle of the interior sides of the ridges 24.

As shown in FIG. 3, the ridges 24 and depressed surfaces 28 are complementary. When one brick 10 is placed atop another, the ridges 24 of the lower brick engage within the depressed surfaces 28 of the upper brick. The sides 33 of the raised portion 30 lie against the inner surfaces 34 of the ridges 24 and the flat depressed surfaces 28 rest and are supported on the tips of the ridges 24. This aligns the side faces of the bricks and prevents sideways movement of one brick relative to the other. In addition, the forces exerted by one brick on another are substantially purely compressive.

It will also be seen, as best shown in FIG. 3, that the projection *d*1 of the portion 30 beyond the depressed surfaces 28 is less than the projection *d*2 of the ridges 24 beyond the recessed surface 26. This provides a space 36 between the bricks. The space 36 helps to prevent small particles present during the laying of the bricks from causing misalignment of the assembled bricks. For this purpose the width *d*3 of the space 36 is quite large, typically at least 40 percent of the width of the brick. The space 36 is also useful for containing mortar to bind the bricks together, and for this purpose the space 36 should be at least 0.3 cm deep. Preferably the space 36 is at least 0.5 cm deep, and will commonly be 0.8 cm or more deep.

When the bricks are assembled, a recess 38 is visible extending along the sides of the bricks at the locations where they join. The recess 38 is produced by the sloping outer surface of the ridges 24, which diverge from the flat depressed surfaces 28. The recess 38 provides an apparent visual gap between the rows of bricks, for decorative purposes. Mortar or sealant may be inserted into the recess 38 if desired.

As shown in FIGS. 1 to 3, one end face 20 may be flat and the other end face 22 may be recessed as shown at 40, to provide a space for mortar between the ends of the bricks, to bond the end faces together.

Figure 4:
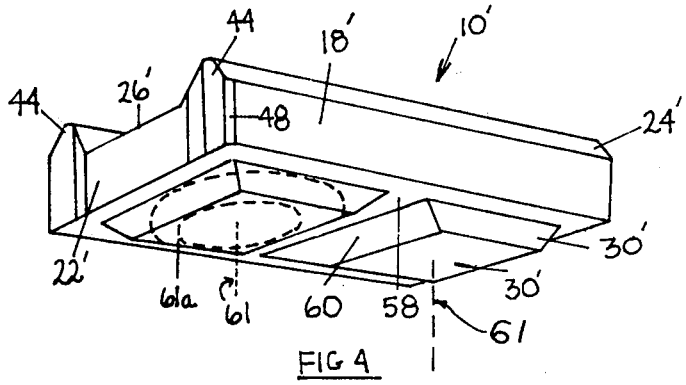
FIG. 4 is a perspective view of a modification of the brick of FIG. 1.
Figure 5:
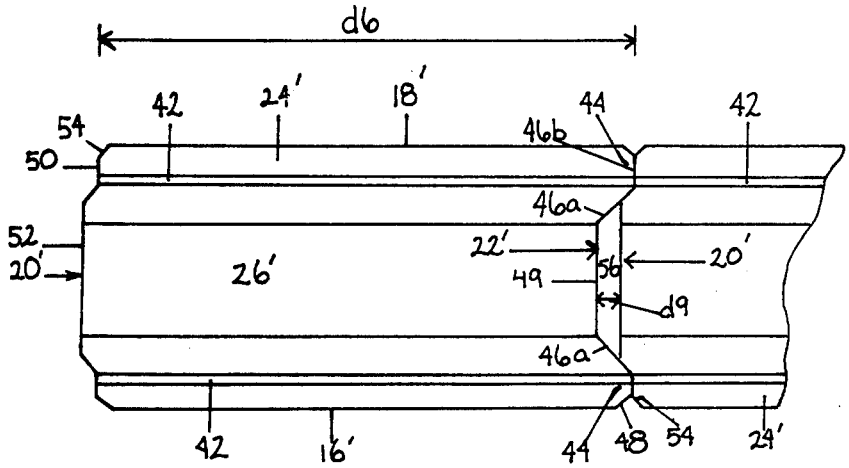
FIG. 5 is a plan view of two of the bricks of FIG. 4 in end to end relation.
Figure 6:
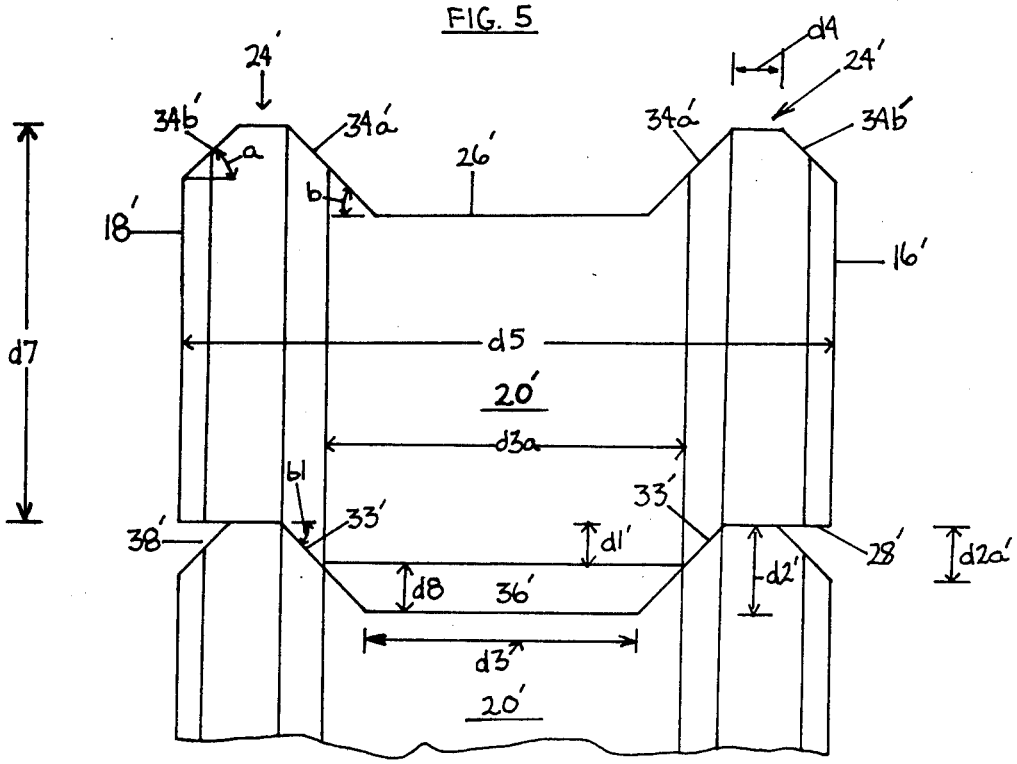
FIG. 6 is an end view of two of the bricks of FIG. 4 in operative relation one above the other.

Reference is next made to FIGS. 4 to 6, which show a brick similar to that of FIGS. 1 to 3. In FIGS. 4 to 6, primed reference numerals indicate parts corresponding to those of FIGS. 1 to 3. The differences between the brick 10' of FIGS. 4 to 6 and the brick 10 of FIGS. 1 to 3 are as follows. Firstly, the recessed area 26' has been recessed more deeply, so the inner faces 34*a'* of the ridges 24' are now longer than the outer faces 34*b'* of the ridges. The angles "*a*" and "*b*" remain (as in the brick 10) 45°. This provides a deeper space 36' for mortar. The outer faces 34*b'* of the ridges 24' have not been deepened since too deep a recess 38' is undesirable (typical dimensions will be given shortly).

Secondly, a flat strip 42 is provided at the top of each ridge 24'. The flat strip 42, although narrow, reduces the likelihood of chips occurring at the apices of the ridges 42.

Thirdly, the end faces 20', 22' are now formed almost exactly like the upper and lower faces 12', 14'. The end face 22' has a pair of vertical ridges 44 one at each side thereof, each having a sloping inner surface 46*a*. The ridges 44 are exactly the same as the ridges 34', except that their outer surfaces 46*b* do not slope fully like surfaces 34*b'*, but instead have only a bevel 48 at their edges. Located between the ridges 44 is a recessed area 49. The end face 20' has a pair of vertically oriented depressed surfaces 50 one at each side thereof, with a projecting portion 52 therebetween. The end face 20 is exactly like the lower face 14, except that its side edges are bevelled as indicated at 54. When two bricks 10' are placed end to end as shown in FIG. 5, the combined width of the two bevels 48, 54, is equal to the depth of the recess 38'. This provides a recess of uniform width (as viewed from the side) around each brick in a wall formed from the bricks. The end faces 20', 22' also define between them a space 56 for mortar. The space 56 has the same cross-sectional dimensions as the space 36'. It will be seen that since end face 20' is complementary to top face 12', and end face 22' is complementary to bottom face 14', an end face can be placed against its complementary top or bottom face while preserving the interlocking features of the bricks.

The final difference between the bricks 10, 10' is that the projecting portion 30' on the bottom face 14' is divided in two by a transverse valley 58 having sides 60 which slope outwardly and downwardly the same as the side surfaces of the portion 30'. With this feature, one brick can be placed crosswise atop another brick and will still interlock therewith. The two parts of the bottom portion 30' are each identical and each have a central vertical axis of symmetry 61. For slightly curved walls, the two parts of the bottom portion 30' may be circular, as indicated in dotted lines 61*a*.

Typical dimensions for the FIGS. 4 to 6 brick are as follows:

*d*1' — 0.7cm
*d*2' — 1.5cm
*d*2*a'* — 1.0cm
*d*3 — 4.5cm
*d*3*a* — 6.1cm
*d*4 — 0.8cm
*d*5 — 11.1cm
*d*6 — 22.2cm
*d*7 — 6.6cm
*d*8 — 0.8cm
*d*9 — 0.8cm

It will be appreciated that the above dimensions can of course be varied, but the feature described above (at least 0.3cm thick spaces 36', 56' for mortar and as wide as possibe, and wide spacing of the support points at which one brick rests on another) should be retained. In addition, the angle *b* can be varied, although a substantial slope is preferred, and angles *b* and *b*1 can also be different (i.e. angle *b*1 can be less than angle *b*), if desired.

Figure 7:
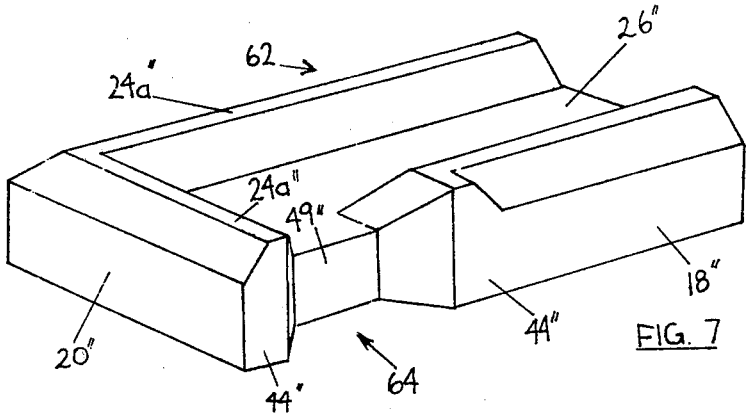
FIG. 7 is a top perspective view of a corner brick of the invention.
Figure 8:
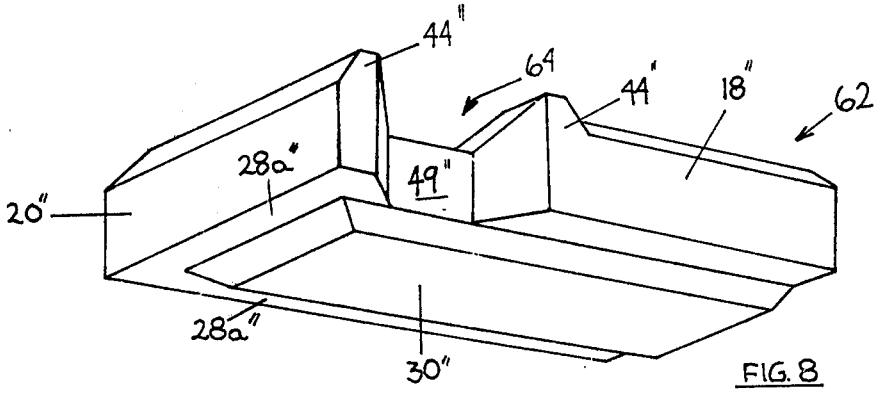
FIG. 8 is a bottom perspective view of a corner brick of FIG. 7.
Figure 9:
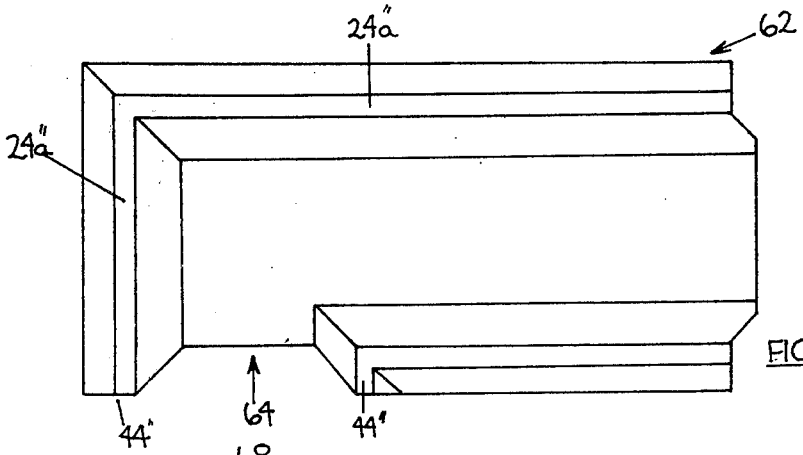
FIG. 9 is a top plan view of the corner brick of FIG. 7.

A corner brick 62 is shown in FIGS. 7 to 9 for use with the brick 10'. The corner brick 62 is the same as brick 10' except for the following differences. One side ridge 24*a''* and one depressed surface 28*a''* are extended along one end face 20'' of the brick. The end face 20'' between the ridge 24*a''* and depressed surface 28*a''* is flat. In addition at the other side of the brick, a receiving face 64 is formed in side face 18''. The receiving face 64 is the same as end face 20' of brick 10', having a pair of ridges 44'' and a recessed area 49'' therebetween. The receiving face 64 is therefore complementary to the end face 20' of brick 10' so that a brick 10' can be laid with its end face 20' interlocked in the receiving face 64.

Figure 10:
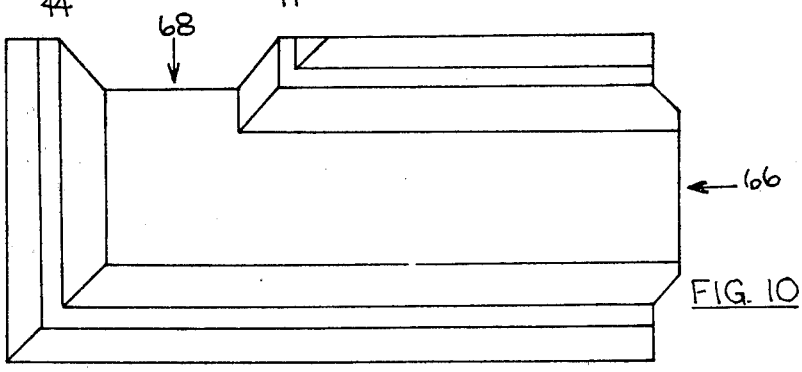
FIG. 10 is a top plan view of a left hand corner brick of the invention.

The corner brick 62 is a right hand brick (the receiving face 64 opens to the right as viewed looking toward the flat end face 20'', and left hand corner bricks 66 are also provided, as shown in FIG. 10. The corner brick 66 is the same as corner brick 62 except that its receiving face 68 opens to the left as viewed looking toward the flat end of brick 66.

If desired, a corner brick may also be made having its receiving face 68 formed exactly like end face 20', i.e. having a projecting portion the same as portion 52, projecting from side face 18" in place of the recessed area 49". However this is less desirable for manufacturing, shipping and storage purposes.

In use, the corner bricks are assembled as shown in FIG. 11, with left and right hand corner bricks 62, 66 alternating vertically, and with ordinary run bricks 10' abutting the end faces of each corner brick. A wall shown at 70 in FIG. 11 is thus formed.

In the construction of a wall such as wall 70, each brick can be mortared when it is laid. Because the space 36 or 36' is wide, if it is necessary to adjust the height of the wall under e.g. a windowsill, this can be done by adding thick mortar in the space 36, 36' to raise the upper brick slightly. The width of sapce 36, 36' is sufficient that enough mortar can be placed in it to support the weight of the upper brick.

Alternatively a substantial portion of a wall can be assembled (the bricks will hold together since they interlock) and then a low viscosity mortar mixture can be poured down one of the spaces 56 between the end faces of two of the bricks in the wall. As shown in the sectional view of FIG. 12, all of the vertical spaces 56 and the horizontal spaces 36' inteconnect. Tests have shown that a thin mortar mixture 72 poured down a vertical space 56 will fill the horizontal spaces 36', 56 in a large portion of the wall. If pumped under pressure, the fill range may be extended further. Thus, a large section of a wall may be assembled without mortar, and may then be mortared in a single simple operation. Provided that the bricks are laid tightly together in end to end relation, little or no mortar will leak out, because it will be seen that the spaces 36, 36' are sealed at their sides by engagement of the ridges 24 against the surfaces of the next brick, and the spaces 56 at the ends of the bricks are similarly sealed. If no mortar is used, any water which penetrates the wall will run out of the interconnecting spaces, so the wall is self-weeping.

Figure 13:
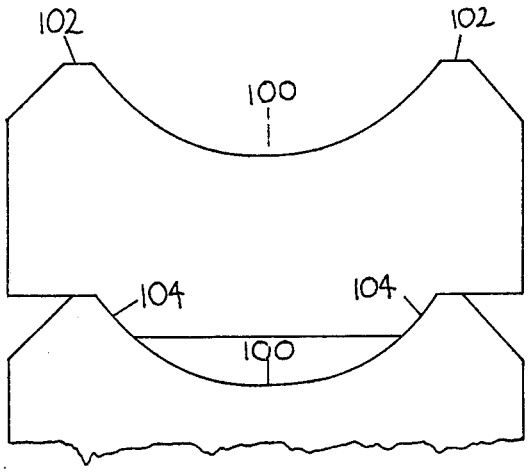
FIG. 13 is an end view of two modified bricks of the invention in operative relation one above the other.
Figure 14:
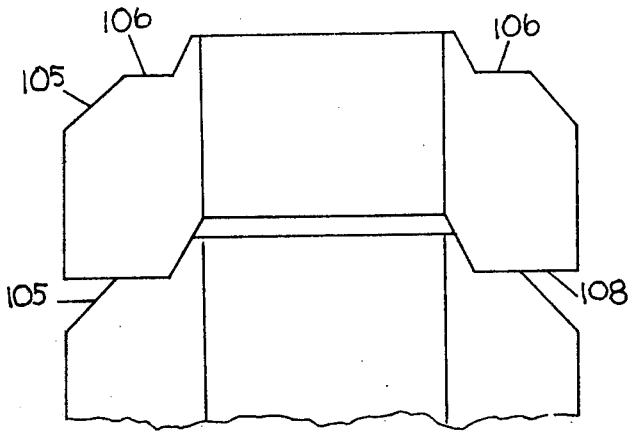
FIG. 14 is an end view of two further modified bricks of the invention in operative relation one above the other.
Figure 15:
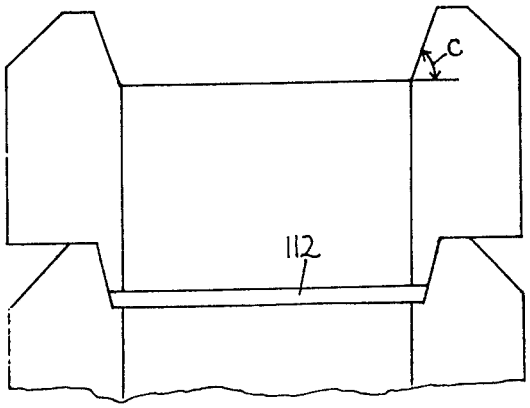
FIG. 15 is an end view of two still further modified bricks of the invention in operative relation one above the other.

Further variations of the brick of the invention are shown in FIGS. 13, 14 and 15. In FIG. 13 the recessed portion 100 between the ridges 102 is curved, and the sides of the raised portion 104 on the lower face of the brick are similarly curved. In FIG. 14 the bevel 105 to provide an edge recess is located at the edges of the depressed surfaces 106 instead of at the edges of the ridges 108. In FIG. 15 the angle "*c*" of the inner surface of the ridges 110 has been steepened to increase the width of the space 112 between the bricks.

Figure 16:
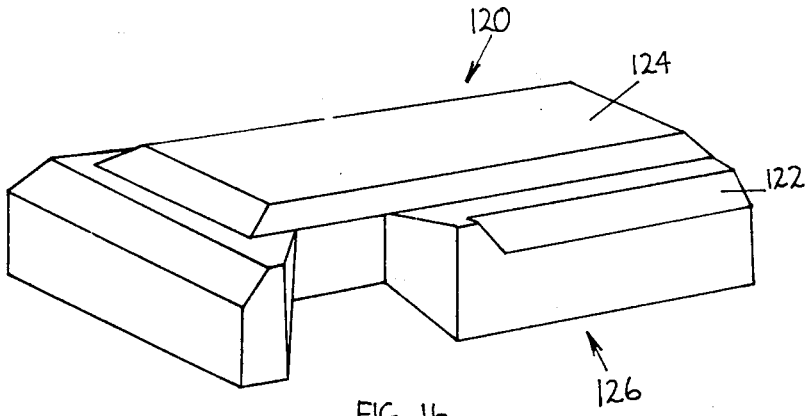
FIGS. 16 and 17 are perspective views of a modified corner brick.
Figure 17:
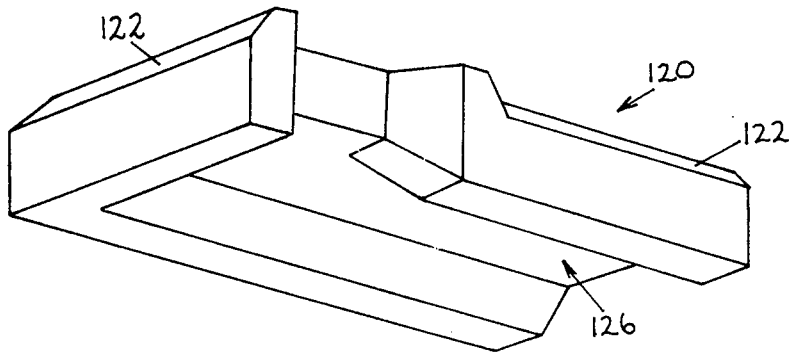

FIGS. 16 and 17 show a corner brick 120 similar to that of FIGS. 7 and 8, the only difference being that the bevel 122 (which forms the exterior side recess between adjacent rows of bricks) is located on the major contact face which contains the raised portion 124, instead of being on the other major contact face 126.

Figure 18:
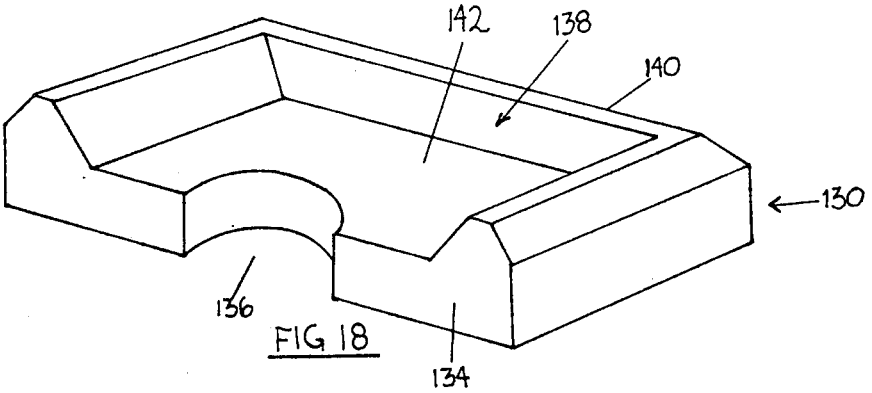
FIGS. 18 and 19 are perspective views of a pillar brick according to the invention.
Figure 19:
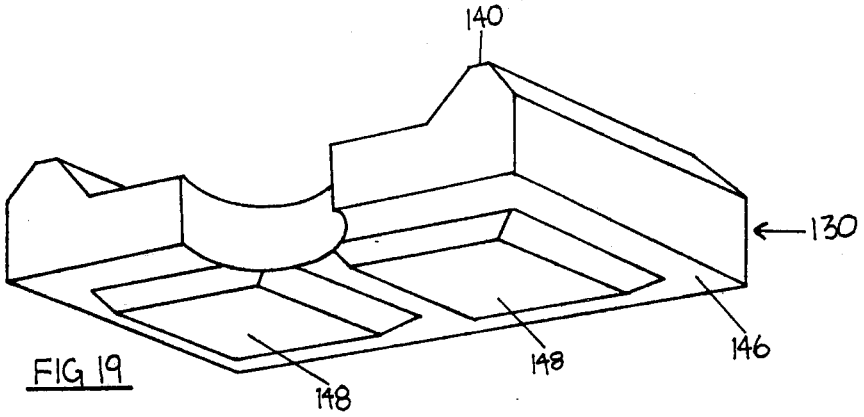
Figure 20:
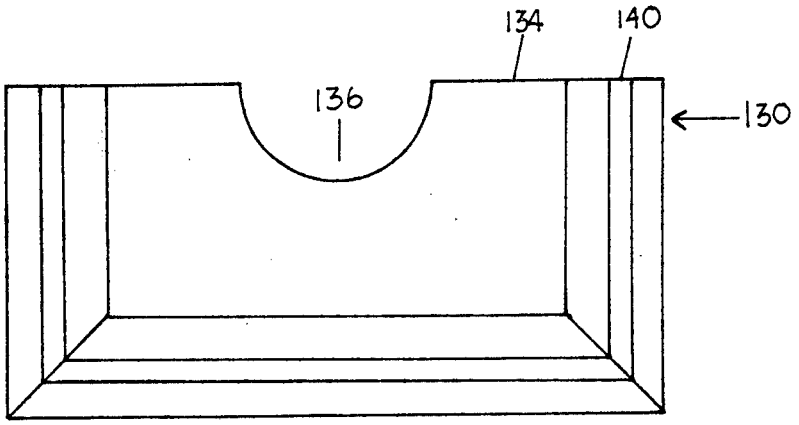
FIG. 20 is a top plan view of the pillar brick of FIGS. 18 and 19.
Figure 21:
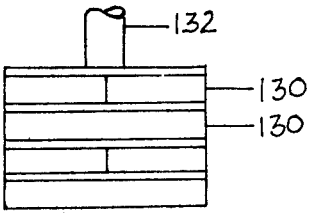
FIG. 21 is an end view of an assembly of the pillar bricks of FIGS. 18 to 20.

FIGS. 18, 19 and 20 show a pillar brick 130 according to the invention. The pillar brick 130 is similar to the brick 10' but is formed so that it can be stacked in pairs (as shown in FIG. 21) about a pillar 132. The pillar brick 130 has one side face 134 which may be simply flat, and which contains a semi-circular opening 136 for the pillar 132. The upper major contact face 138 of brick 130 contains ridges 140 (which are the same as ridges 24' of brick 10') along its remaining three edges, with a recessed surface 142 between the ridges. The lower major contact face 144 of brick 130 contains depressed surfaces 146 along all of its sides, with raised portions 148 within the depressed surfaces 146. The interlocking fit of the pillar bricks is exactly the same as that of the bricks 10 previously described, and the assembly produces a square with the pillar 132 at its centre.

What is claimed is:

1. A building brick having:

(a) upper and lower faces (b) first and second end faces, (c) first and second side faces, (d) said upper face having a pair of parallel upstanding ridges one adjacent each side of said brick and each ridge extending substantially the entire length of said brick, said upper face having a first recessed portion between said ridges, and said first recessed portion extending substantially the entire length of said brick, (e) each ridge being substantially triangular in form, having an outer surface which slopes steeply in a direction towards its adjacent side face and towards said bottom face to form, when one said brick is placed atop another, an edge recess extending along each side of the join between adjacent said bricks, each ridge also having a narrow flat apex surface, and an inner surface which slopes steeply laterally inwardly toward said recessed portion, (f) said lower face having a pair of narrow flat depressed surfaces one at each side of said brick and extending substantially the entire length of said brick, and a raised portion between said depressed surfaces, said raised portion having sides which slope laterally outwardly to meet said depressed surfaces, said depressed being located vertically beneath said apex surfaces in vertical alignment therewith, (g) said depressed surfaces and ridges and said raised and recessed portions being complimentary in height and location so that when one brick is placed atop another, said inner surfaces of said ridges meet and lie against said sides of said raised portion to align said faces of said bricks and to restrain sideways movement of one of said bricks relative to the other and said depressed surfaces of the upper brick rest sealingly on said flat apex surfaces thereby carrying the weight of the upper brick, (h) the projection of said ridges beyond said first recessed portion being at least 0.3 cm greater than the projection of said raised portion beyond said depressed surfaces, to provide a horizontal space at least 0.3 cm high between successive rows of said bricks for bonding material, the width of said space being at least 40 percent of the width of said bricks, (i) said first end face having a pair of projecting vertical edge portions, one adjacent each ridge of said brick and extending substantially the entire height of said brick, and having a second recessed portion between said edge portions, said second recessed portion extending substantially the entire height of said brick, (j) said second end face having a pair of flat end surfaces one adjacent each side of said brick and extending substantially the entire height of said brick, and a central portion between said flat end surfaces, said flat end surfaces and said vertical edge portions, and said second recessed portion and said central portion being complimentary so that when said first and second end faces of two said bricks are placed end to end, said flat end surfaces lie sealingly against said vertical edge portions, (k) said second recessed portion and said central portion defining between the first and second end faces of said bricks placed end to end a vertical space extending the entire height of said bricks for containing bonding material, said vertical space being at least 0.3 cm thick and the edges thereof being sealed by contact of said edge portions against said flat end surfaces of such other brick, so that when said bricks are assembled into a wall, flowable bonding material may be poured into one of said vertical spaces for filling other said vertical and horizontal spaces between bricks in said wall.

2. A brick according to claim 1 wherein the first raised portion includes a transverse valley dividing said raised portion into two identical parts each having a central vertical axis of symmetry.

3. A brick according to claim 1 wherein said vertical edge portions and said second depressed side surfaces all have bevelled edges, said bevelled edges when two said bricks are placed end to end defining a v-shaped notch of longitudinal extent equal to the height of the vertical component of said outer surfaces of said ridges.

4. A wall comprising a plurality of building bricks, wherein (1) each brick has:

(a) upper and lower faces, (b) first and second end faces, (c) first and second side faces, (d) said upper face having a pair of parallel upstanding ridges one adjacent each side of said brick and each ridge extending substantially the entire length of said brick, said upper face having a first recessed portion between said ridges, and said ridges, and said first recessed portion extending substantially the entire length of said brick, (e) each ridge being substantially triangular in form, having an outer surface which slopes steeply in a direction towards its adjacent side face and towards said bottom face to form, when one said brick is placed atop another, an edge recess extending along each side of the join between adjacent said bricks, each ridge also having a narrow flat apex surface, and an inner surface which slopes steeply laterally inwardly toward said recessed portion, (f) said lower face having a pair of narrow flat depressed surfaces one at each side of said brick and extending substantially the entire length of said brick, and a raised portion between said depressed surfaces, said raised portion having sides which slope laterally outwardly to meet said depressed surfaces, said depressed surfaces being located vertically beneath said apex surfaces in vertical alignment therewith, (g) said depressed surfaces and ridges and said raised and recessed portions being complementary in height and location so that when one brick is placed atop another, said inner surfaces of said ridges meet and lie against said sides of said raised portion to align said side faces of said bricks and to restrain sideways movement of one of said bricks relative to the other, and said depressed surfaces of the upper brick rest sealingly on said flat apex surfaces of the lower brick, said apex surfaces thereby carrying the weight of the upper brick, (h) the projection of said ridges beyond said first recessed portion being at least 0.3 cm greater than the projection of said first raised portion beyond said depressed surfaces, to provide a horizontal space at least 0.3 cm high between successive rows of said bricks for bonding material, the width of said space being at least 40 percent of the width of said bricks, (i) said first end face having a pair of projecting vertical edge portions, one adjacent each edge of said brick and extending substantially the entire height of said brick, and having a second recessed portion between said edge portions, said second recessed portion extending substantially the entire height of said brick, (j) said second end face having a pair of flat end surfaces one adjacent each side of said brick and extending substantially the entire height of said brick, and a central portion between said flat end surfaces, said flat end surfaces and said vertical edge portions, and said second recessed portion and said central portion being complementary so that when said first and second end faces of two said bricks are placed end to end, said flat end surfaces lie sealingly against said vertical edge portions, (k) said second recessed portion and said central portion defining between the first and second end faces of said bricks placed end to end a vertical space extending the entire height of said bricks for containing bonding material, said vertical space being at least 0.3 cm thick and the edges thereof being sealed by contact of said edge portions against said second end face of such other brick, so that when said bricks are assembled into a wall, flowable bonding material may be poured into one of said vertical spaces for filling other said vertical and horizontal spaces between bricks in said wall, (2) said wall including bonding material filling said horizontal spaces, said bonding material being introduced by pouring it in a runny state through at least one of said vertical spaces and said bonding material flowing from said vertical to said horizontal spaces to fill all said spaces.

* * * * *